US006971342B1

(12) United States Patent
Grabbe

(10) Patent No.: US 6,971,342 B1
(45) Date of Patent: Dec. 6, 2005

(54) ADJUSTABLE COMPRESSION RATIO APPARATUS

(76) Inventor: Wallace W. Grabbe, 1133 Salvador St., Costa Mesa, CA (US) 92626-5566

( * ) Notice: Subject to any disclaimer, the term of this patent is extended or adjusted under 35 U.S.C. 154(b) by 0 days.

(21) Appl. No.: 11/142,425

(22) Filed: Jun. 1, 2005

(51) Int. Cl.[7] ..... F02B 75/04
(52) U.S. Cl. ..... 123/48 B; 123/78 F
(58) Field of Search ..... 123/48 B, 78 F

(56) References Cited

U.S. PATENT DOCUMENTS

| | | | | |
|---|---|---|---|---|
| 1,111,252 | A | 9/1914 | Eagle | |
| 1,553,009 | A | 9/1925 | Stuke | |
| 2,433,639 | A | 12/1947 | Woodruff et al. | |
| 2,589,958 | A | 3/1952 | Petit | |
| 3,633,552 | A | 1/1972 | Huber | |
| 3,861,239 | A | 1/1975 | McWhorter | |
| 4,026,252 | A | 5/1977 | Wrin | |
| 4,485,768 | A | 12/1984 | Heniges | |
| 4,738,230 | A | 4/1988 | Johnson | |
| 4,887,560 | A | 12/1989 | Heniges | |
| 5,755,195 | A | 5/1998 | Dawson | |
| 5,960,750 | A | 10/1999 | Kreuter | |
| 6,247,430 | B1 * | 6/2001 | Yapici | 123/48 B |
| 6,453,869 | B1 | 9/2002 | Moore | |
| 6,588,384 | B2 * | 7/2003 | Yapici | 123/48 B |
| 6,637,384 | B1 * | 10/2003 | Mendler | 123/48 B |
| 6,732,683 | B2 | 5/2004 | Weiss | |
| 6,843,212 | B2 | 1/2005 | Shimizu et al. | |

FOREIGN PATENT DOCUMENTS

| | | | |
|---|---|---|---|
| DE | 3108486 A1 * | 9/1982 | F02D 15/00 |
| DE | 4226361 | 4/1994 | |
| FR | 2669676 A1 * | 5/1992 | F02B 75/04 |

OTHER PUBLICATIONS

Derwent Acc No: 1996-127084; "Variable Compression ratio engine, with eccentric main bearing-has servo motor . . . " Feb. 10, 1996.*

* cited by examiner

*Primary Examiner*—Noah P. Kamen
(74) *Attorney, Agent, or Firm*—Walter A. Hackler

(57) ABSTRACT

Apparatus is provided for adjusting a compression ratio of an engine having a crankshaft, a plurality of combustion cylinders, a moveable piston disposed within each combustion cylinder, and rods connecting each piston of the crankshaft. The apparatus generally includes a plurality of bearings surrounding a crankshaft at each main bearing with each bearing having an offset bore therethrough supporting the crankshaft. Rotational displacement of the bearings causes off axis displacement of the crankshaft along the longitudinal axes of the rods, thus raising and lowering the scope of movement of each piston and thereby increasing and decreasing the compression ratio without changing piston stroke. Rotational displacement of the bearings may be provided through an actuator interconnected to a throttle linkage.

7 Claims, 3 Drawing Sheets

ADJUSTABLE COMPRESSION RATIO APPARATUS

The present invention is generally related to improvements in internal combustion engines having reciprocating pistons and is more particularly directed to apparatus for varying the cylinder compression ratio during operation in order to optimize the efficiency of the engine.

The gasoline engine is inefficient because it has a high compression only when it is at "full throttle", at a time when wind resistance is at its peak, and the carburetor is receiving an extra rich mixture of fuel to avoid burning the engine. And engines today are designed "square" (piston diameter is about equal to the stroke). It is necessary in order to get good performance at high speed. A longer stroke would get more energy from the fuel.

When the firing chamber is made smaller in order to increase the compression ratio when the engine power is less than full, it increases the number of times the energy giving gasses are allowed to expand in the power stroke and therefore also adds to the engine efficiency.

Inventors have recognized this shortcoming of the gasoline engine from the beginning of time and have made many attempts to correct it. It is evident that most inventors don't account for the extreme forces they are dealing with in the crank case.

Another negative in correcting this shortcoming seems to be the necessity of adding so much gadgetry to such a simple machine. This becomes a small objection when considering the recent changes in the availability of fuel today. It also seems a better path than adding batteries, generators and electric motors.

SUMMARY OF THE INVENTION

Apparatus in accordance with the present invention is provided for adjusting a compression ratio of an engine having a crankshaft, combustion cylinders, a moveable piston disposed within each of the combustion cylinders, and rods connecting each piston to the crankshaft (connecting rods).

More specifically, the apparatus includes bearings supporting the crankshaft in the engine block (main bearings). Each of these main bearing have an offset bore therethrough for supporting the crankshaft. Angular displacement of the bearings causes a vertical displacement of the crankshaft along a longitudinal axis of the rods, thus increasing and decreasing the compression ratio without changing the stroke of the piston. "Vertical" is meant in the present application to be along the longitudinal axes of the connecting rods.

Means are provided for causing angular displacement of the bearings and in one embodiment, the means includes offset bushing arms connected to a control shaft through shaft lever arms and lever arm linkages.

More particularly, the apparatus further includes a control shaft actuator connected to the control shaft by an actuator arm and a throttle linkage. In this manner, movement of the throttle linkage effects operation of the apparatus and ultimate control of the compression ratio.

Still more particularly, the actuator may include a fixed actuator piston with a head disposed in a moveable actuator chamber with the chamber being fixed to the actuator arm. A shuttle valve cylinder is provided and fixed to the actuator chamber for movement therewith and includes two hydraulic fluid ports communicating with the actuator chamber. One of the ports is disposed on one side of the actuator piston head and another of the ports is disposed on another side of the actuator piston head.

A throttle linkage includes a pair of shuttle valves with each valve aligned for covering and uncovering a respective port. In addition, hydraulic fluid inputs into the shuttle valve chamber are provided at opposite ends thereof and a hydraulic fluid output is provided from the shuttle valve chamber and disposed between the hydraulic fluid inputs and shuttle valves.

In another embodiment of the present invention, a means for causing angular displacement of the bearing includes offset bushing arms with each arm having a toothed arcuate segment. A control gear engaging the toothed segment is hydraulic or electric motor (not shown) provided for causing angular displacement of the bushing arms and bearing by way of, for example, an electric or hydraulic motor.

BRIEF DESCRIPTION OF THE DRAWINGS

The present invention may be more clearly appreciated when taken in conjunction with the accompanying drawings in which.

DETAILED DESCRIPTION

Figure 1:
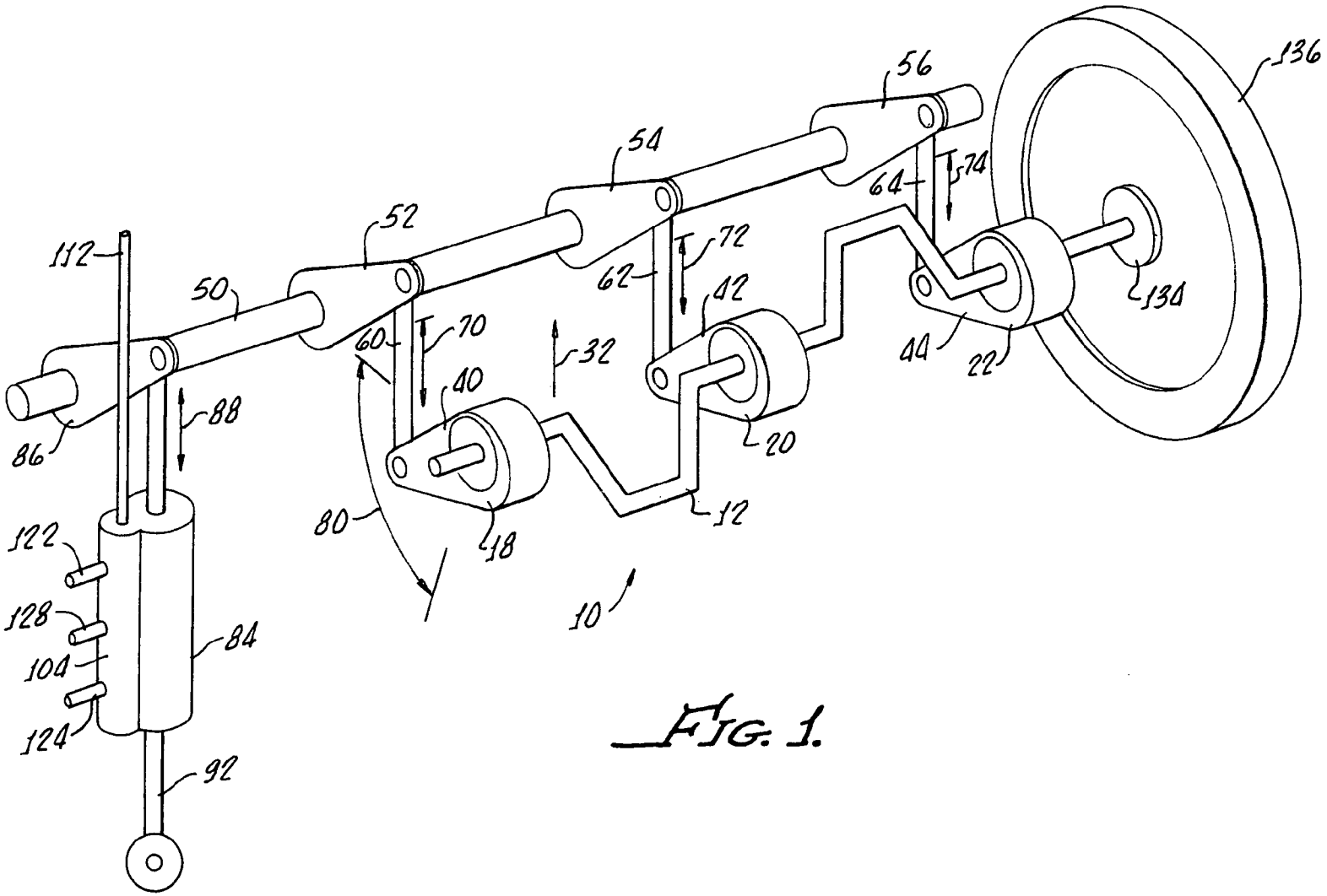
FIG. 1 is a diagram of apparatus for adjusting the compression ratio of an engine generally showing a crankshaft along with a plurality of bearings surrounding the crankshaft along with a control shaft, shaft lever arms, and control shaft actuator which provides a means for causing angular displacement of the bearings as hereinafter described.

With reference to FIG. 1, there is diagramed apparatus 10 in accordance with the present invention for adjusting a compression ratio of an engine (not shown) having a crankshaft 12. The engine includes a plurality of combustion cylinders, a moveable piston disposed within each of the combustion cylinders, and rods connecting each piston to the crankshaft 12, these elements, not being claimed are omitted from the drawings for the sake of clarity.

Figure 2:
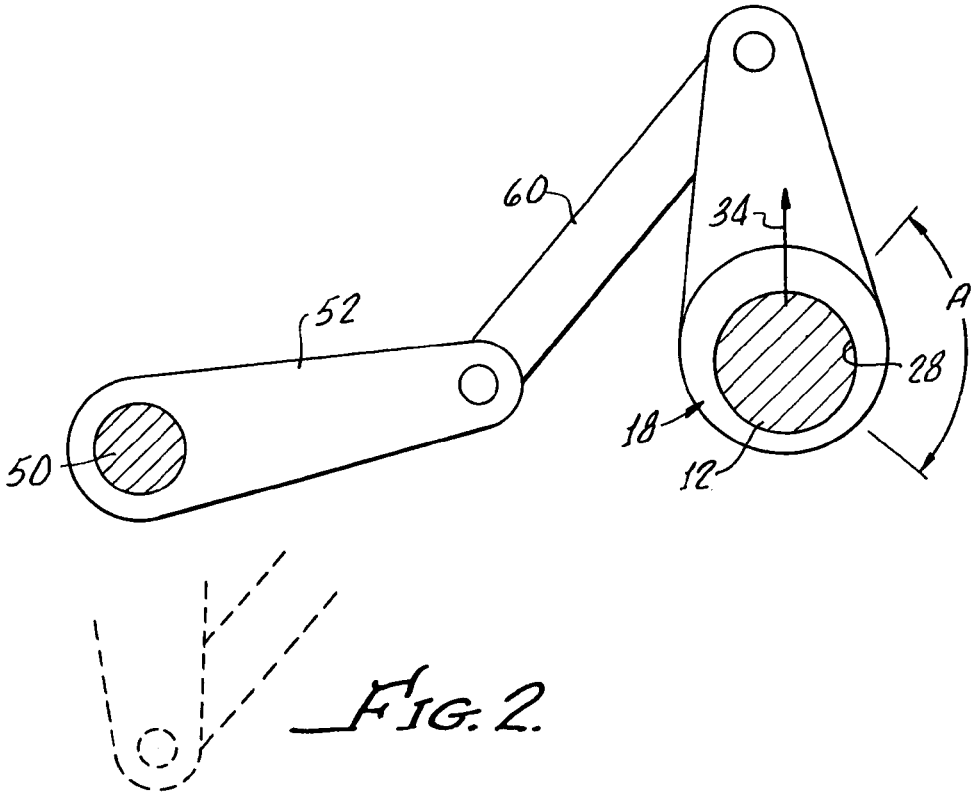
FIG. 2 is a simplified diagram of the shaft lever arm, lever arm linkage, offset bushing lever arm, and crankshaft with phantom line illustrating movement of the shaft lever arms.

The apparatus 10 includes a plurality of bearings 18, 20, 22, surrounding the crankshaft 12 at every main bearing of the engine. As shown in FIG. 2 bearing 18 includes an offset bore therethrough for supporting a crankshaft 12, only one bearing 18 being shown for the sake of clarity.

It should be apparent that angular displacement as indicated by the arrows A in FIG. 2 causes off axis displacement of the crankshaft 12 as illustrated by the arrow 32 in FIG. 1. As shown a 90° rotation of the bearing 18 equals approximately a 5/16–3/8 inch of vertical travel for a 4 inch stroke engine. This is also illustrated by the arrow 34 in FIG. 2.

Figure 3:
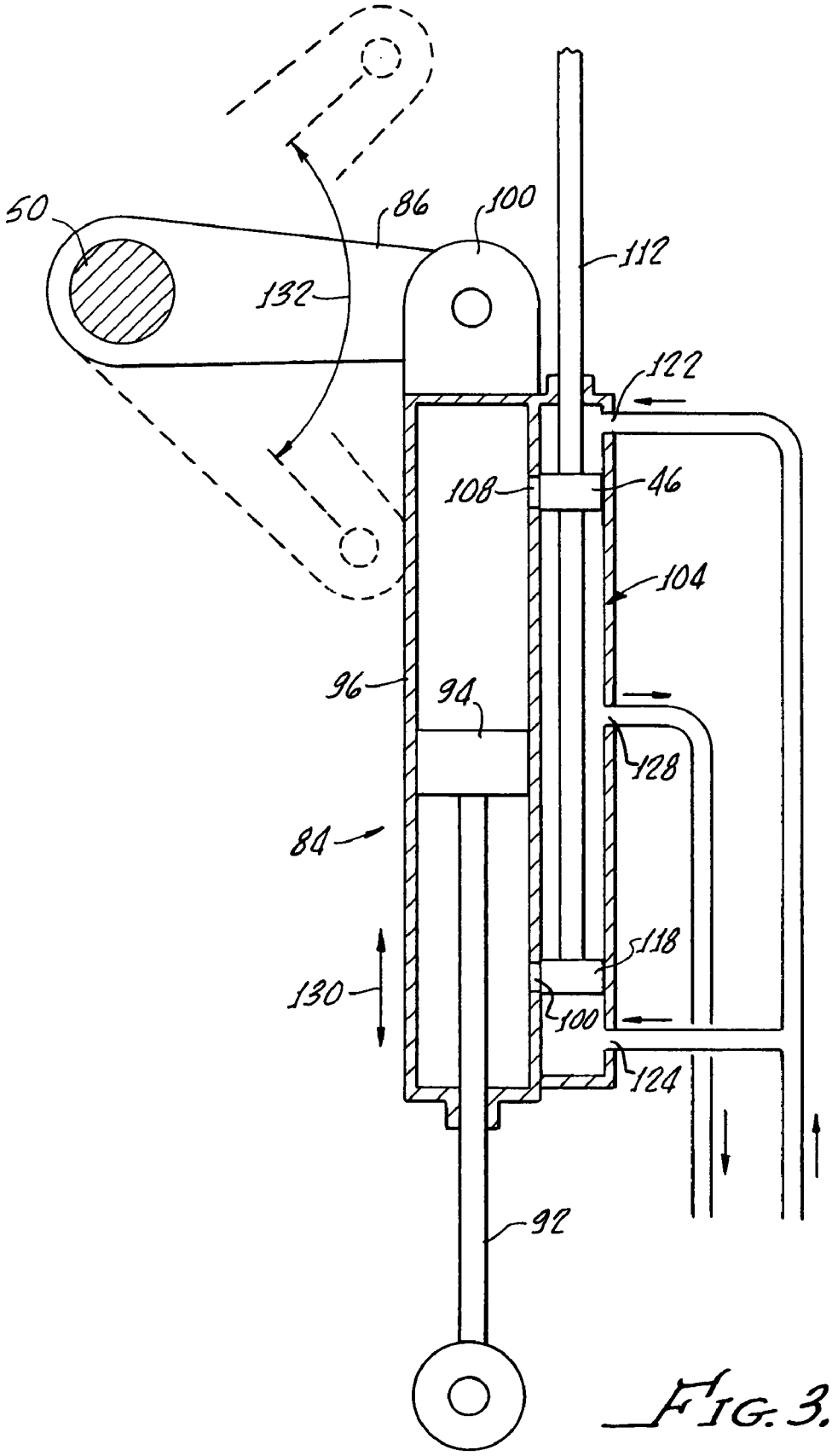
FIG. 3 is a diagram of the actuator shown in FIG. 1 in cross section generally showing the control shaft, a fixed piston, moveable actuation chamber, throttle linkage, and shuttle valves for operation of the actuator.

In one embodiment of the present invention illustrated in FIGS. 1–3 offset bushing arms 40, 42, 44 are connected to a control shaft 50 through shaft lever arms 52, 54, 56 in linkages 60, 62, 64.

Movement of the linkages 60, 62, 64 by the rotating control shaft 50 indicated by the arrows 70, 72, 74 causes angular displacement of the bearings 18, 20, 22 respectively as indicated by the arrow 80.

Rotation of the control shaft 50 is caused by an actuator 84 through an actuator arm 86 illustrated by arrow 88.

With reference to FIG. 3, the actuator 84 includes a fixed piston 92 having a head 94 disposed in a moveable actuator chamber 96, the chamber 96 having a fitting 100 attached to the actuator arm 86.

The actuator 84 further includes a shuttle valve cylinder 104, which is affixed to the actuator chamber 96 and two hydraulic ports 108, 110 are provided for communicating hydraulic fluid therebetween.

A throttle linkage 112 includes shuttle valves 116, 118 aligned for covering and uncovering a respective port 108, 110 by movement of the throttle linkage 112. Hydraulic fluid inputs 122, 124 are provided at opposing ends of the shuttle valve chamber 104 and a hydraulic fluid output 128 is disposed between the hydraulic fluid inputs 122, 124 and shuttle valves 116, 118.

It is clear from FIG. 3 that a movement of the shuttle valves 116, 118 by the throttle linkage 112 causes vertical linear movement of the actuator chamber 96 as indicated by the arrow 130 which translates into rotational movement of the control shaft 50 as indicated by the arrow 132.

Thus, the compression control is directly related to the engine throttle (not shown) through the throttle linkage 112. The off access movement of the crankshaft 12 is accommodated by a conventional universal joint 134 interconnected with a fly wheel 136 in a conventional manner, see FIG. 1.

Figure 4:
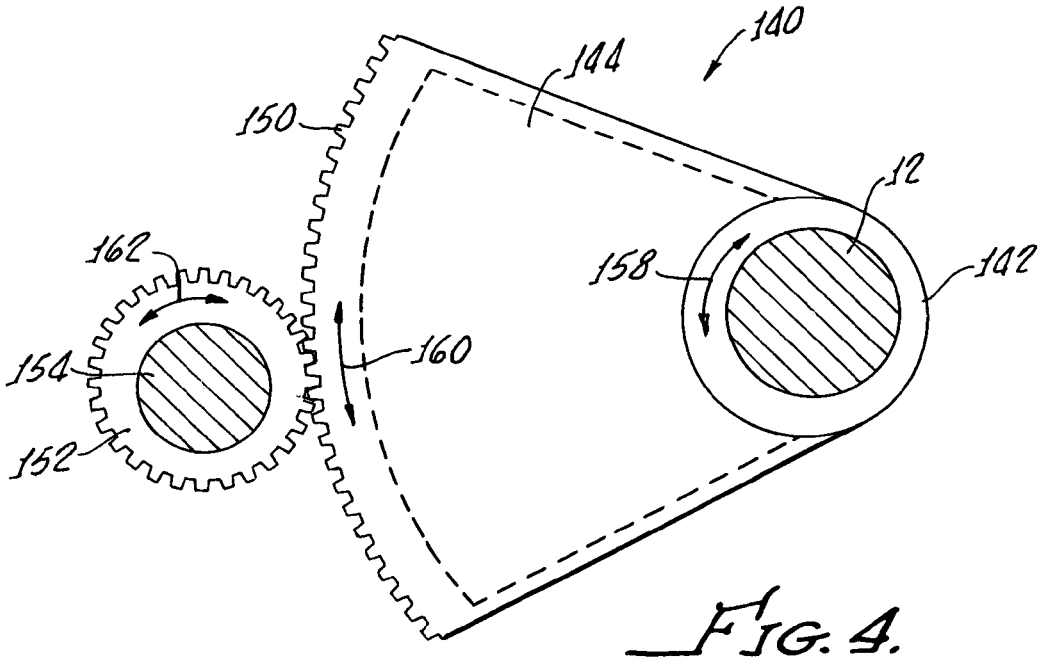
FIG. 4 is an alternative embodiment of the present invention in which an offset bushing lever arm has a toothed arcuate segment which engages a control gear, this alternative being powered by an electric or hydraulic motor (not shown).

With reference to FIG. 4, there is an alternative embodiment 140 which provides a means for causing angular displacement of a bearing 42 surrounding the crankshaft 12, only one of the bearings 142 being shown for clarity. Each offset bearing 142 includes a bushing arm 144 with a toothed arcuate segment 150 which engages a control gear 152 surrounding a control shaft 154 which extends through the length of the engine block (not shown) and controls the rotational position of the offset bushing 152 as shown by arrows 158, 160, 162.

Although there has been hereinabove described a specific adjustable compression ratio apparatus in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. Apparatus for adjusting a compression ratio of an engine having a crankshaft, at least one combustion cylinder, a moveable piston disposed within the combustion cylinder, and a rod connecting the piston to the crankshaft, said apparatus comprising:

a plurality of bearings surrounding said crankshaft at all main bearings, each bearing having an offset bore therethrough supporting said crankshaft, rotational displacement of the bearings causing off axis vertical displacement of said crankshaft along longitudinal axes of said rods thus raising and lowering the crankshaft and connecting pistons without changing a stroke of the piston;

means for causing vertical angular displacement of the bearings, said means including offset bushing arms connected to a control shaft through shaft arm levers and lever arm linkages;

a control shaft actuator connected to the control shaft by an actuator arm and a throttle linkage, movement of the throttle linkage effecting operation of said actuator.

2. The apparatus according to claim 1 wherein the actuator includes a fixed actuator piston having a head disposed in a moveable actuation chamber, the chamber being fixed to the actuator arm.

3. The apparatus according to claim 2 further comprises a shuttle valve cylinder fixed to the actuator chamber and including two hydraulic fluid ports communicating with the actuator chamber, one of the ports being disposed on one side of the actuator piston head and another of the ports being disposed on another side of the actuator piston head.

4. The apparatus according to claim 3 wherein said throttle linkage includes a pair of shuttle valves, each valve aligned for covering and uncovering a respective port.

5. The apparatus according to claim 4 further comprising hydraulic fluid inputs into said shuttle valve chamber at opposite ends thereof.

6. The apparatus according to claim 5 further comprises a hydraulic fluid output from said shuttle valve chamber between the hydraulic fluid inputs and shuttle valves.

7. The apparatus according to claim 1 wherein the means for causing rotational displacement of the bearing includes offset bushing arms each having a toothed arcuate segment and a control gear engaging said toothed radius.

* * * * *